US006708518B1

(12) United States Patent
Jones et al.

(10) Patent No.: US 6,708,518 B1
(45) Date of Patent: Mar. 23, 2004

(54) REFRIGERATOR DOOR DISPENSER SPILL SHELF DRAIN

(76) Inventors: Eangla Taylor Jones, 612 Dixon Dr., Richmond, VA (US) 23224; Lorenzo Jones, 612 Dixon Dr., Richmond, VA (US) 23224

( * ) Notice: Subject to any disclaimer, the term of this patent is extended or adjusted under 35 U.S.C. 154(b) by 0 days.

(21) Appl. No.: 10/392,779

(22) Filed: Mar. 20, 2003

(51) Int. Cl.[7] ..... B67D 5/62
(52) U.S. Cl. ..... 62/389; 62/291; 222/146.6
(58) Field of Search ..... 62/291, 389, 390; 222/146.6

(56) References Cited

U.S. PATENT DOCUMENTS 3,934,758 A * 1/1976 Kipp ..... 222/108
4,341,328 A * 7/1982 Redick, Jr. ..... 222/83.5
5,405,526 A * 4/1995 Sutera ..... 210/124
5,699,677 A * 12/1997 Hakala et al. ..... 62/291
6,438,989 B1 * 8/2002 Wolski et al. ..... 62/390

* cited by examiner

*Primary Examiner*—William E. Tapolcai

(57) ABSTRACT

The present invention relates to a refrigerator door dispenser spill shelf drain system that is connected at one end to the spill collection tray of the dispensing unit and is connected at the other end to a collector pan. The water is routed through tubing from the spill shelf to the collector evaporator pan, which is mounted atop the condenser of the refrigerator. The heat from the condenser helps to evaporate the water that accumulates there after draining from the spill shelf.

20 Claims, 2 Drawing Sheets

REFRIGERATOR DOOR DISPENSER SPILL SHELF DRAIN

BACKGROUND OF THE INVENTION

1. Field of the Invention

The present invention relates to a refrigerator door dispenser spill shelf drain for use in connection with refrigerator door mounted ice and water dispensers. The refrigerator door dispenser spill shelf drain has particular utility in connection with production of new refrigerators.

2. Description of the Prior Art

Refrigerator door dispenser spill shelf drains are desirable for draining spillage or overflow water or ice that would otherwise accumulate in the shelf. The water or ice can spill out of the shelf when the shelf is removed to be emptied and create a mess or potential slip hazard. The accumulated water or ice melt can also mold or mildew in the shelf.

The use of door mounted water and ice dispensers is known in the prior art. For example, U.S. Pat. No. 5,971,213 to Lee discloses one way to provide cooled water for the consumer's convenience from a refrigerator door mounted water dispenser. However, the Lee '213 patent does not provide overflow protection, and has further drawbacks of not providing drainage for spilled water from the water collection and receiving tray to a separate collection pan for evaporation.

U.S. Pat. No. 6,058,718 to Forsberg et al. discloses a portable potable water recovery and dispensing apparatus that provides a means for collecting water from the ambient air and dispensing the collected water, either heated or chilled or as ice. However, the Forsberg '718 patent does not provide overflow protection for the spill collection tray, and has further drawbacks of not providing drainage for spilled ice or water from the water collection tray, as the tray requires intervention by the user to drain the water.

Similarly, U.S. Pat. No. 5,906,110 to Choi discloses a receiving and discharging apparatus that fits within a refrigerator that collects water produced during the defrosting and operation of the cooler coils. However, the Choi '110 patent does not provide the same structure or function as the present invention, and can not provide removal of the accumulated water from the drip collection tray of a door mounted ice and water dispenser without user intervention.

Also, U.S. Pat. No. 5,542,265 to Rutland discloses a door mounted water dispenser that has an internally mounted water container in which the water is cooled. However, the Rutland '265 patent does not contain the same structure as the present invention as it requires user intervention to empty the accumulated water, and cannot provide drainage for the water spilled from the dispenser and route the water to a collection and evaporation pan.

Additionally, U.S. Pat. No. 5,279,445 to Fisher et al. discloses a cable operated ice dispensing door that operates to rapidly close the ice dispensing door of a drink dispensing machine to thereby curtail the loss of ice from the insulated ice storage area. However, the Fisher '445 patent does not have the same structure as the present invention, and can not provide for the collection of the melted ice and spilled water for evaporation as does the present invention.

Lastly, U.S. Pat. No. Des. 369,719 to Eddy et al. discloses a drip tray for a domestic water cooler that attaches to slots on the cooler to collect drips and spills from the cooler. However, the Eddy '719 patent does not provide the same structure as the present invention, and has the additional deficiency of not being self-draining to an internally contained evaporation pan and therefore requires user intervention to empty the accumulated water from the tray.

While the above-described devices fulfill their respective, particular objectives and requirements, the aforementioned patents do not describe a refrigerator door dispenser spill shelf drain that allows for internal collection and disposal of the water drained from the spill tray. The Choi '110 patent is directed towards a different problem with refrigerators, and thus makes no provision for self-draining of the collected water, as the disclosed drip collector requires intervention by the user to remove the accumulated water. The Fisher '445 patent is an improvement in its area, as it provides a drain mechanism for spilled ice or melt water but does not have the same structure of the present invention, as it does not provide an internal evaporation container to collect and evaporate the collected water but requires attachment to an external drain.

Therefore, a need exists for a new and improved refrigerator door dispenser spill shelf drain that can be used for integration on door mounted refrigerator ice and water dispenser spill trays. In this regard, the present invention substantially fulfills this need. In this respect, the refrigerator door dispenser spill shelf drain according to the present invention substantially departs from the conventional concepts and designs of the prior art, and in doing so provides an apparatus primarily developed for the purpose of obviating the need for user intervention to remove spilled ice or water from the spill collection tray.

SUMMARY OF THE INVENTION

In view of the foregoing disadvantages inherent in the known types of door mounted ice and water dispenser spill trays now present in the prior art, the present invention provides an improved refrigerator door dispenser spill shelf drain, and overcomes the above-mentioned disadvantages and drawbacks of the prior art. As such, the general purpose of the present invention, which will be described subsequently in greater detail, is to provide a new and improved refrigerator door dispenser spill shelf drain which has all the advantages of the prior art mentioned heretofore and many novel features that result in a refrigerator door dispenser spill shelf drain which is not anticipated, rendered obvious, suggested, or even implied by the prior art, either alone or in any combination thereof.

To attain this, the present invention essentially comprises a drain system that is connected at one end to the spill collection tray of a refrigerator door mounted ice and water dispenser and terminates at a collection and evaporation pan located atop the condenser of the refrigerator. The drain system serves to remove the water that would otherwise collect in the spill collection tray. The drain system uses tubing that can be formed using plastic, vinyl, copper tubing or similar flexible material, either singularly or in combination. The drained water is routed through grommets or similar guides placed in the refrigerator door and wall to prevent pinching or impingement of the drain tube.

There has thus been outlined, rather broadly, the more important features of the invention in order that the detailed description thereof that follows may be better understood and in order that the present contribution to the art may be better appreciated.

The invention may also include a coiled portion in the drain tube to allow for free movement of the drain tube to minimize pinching or impingement of the drain tube when the door is opened. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved refrigerator door dispenser spill shelf drain that has all of the advantages of the prior art water and ice spill collectors and none of the disadvantages.

It is another object of the present invention to provide a new and improved refrigerator door dispenser spill shelf drain that may be easily and efficiently manufactured and marketed.

An even further object of the present invention is to provide a new and improved refrigerator door dispenser spill shelf drain that has a low cost of manufacture with regard to both materials and labor, and which accordingly is then susceptible of low prices of sale to the consuming public, thereby making such refrigerator door dispenser spill shelf drain economically available to the buying public.

Still another object of the present invention is to provide a new refrigerator door dispenser spill shelf drain that provides in the apparatuses and methods of the prior art some of the advantages thereof, while simultaneously overcoming some of the disadvantages normally associated therewith.

Even still another object of the present invention is to provide a refrigerator door dispenser spill shelf drain for minimizing the potential for slips and falls caused by the spillage of water onto the floor, either as the spill collection tray overflows or is spilled while being emptied. This allows for increased safety in the home and less potential for injuries.

The refrigerator door dispenser spill shelf drain further prevents an accumulation of stagnant water is the home, thus helping to reduce mold, mildew or odor potentially caused by the water standing in the spill collection tray.

Lastly, it is an object of the present invention to provide a new and improved refrigerator door dispenser spill shelf drain for ease of cleaning. The refrigerator door dispenser spill shelf drain greatly aids in this regard as it does not need to be removed to empty, thus removing any chance of spilling the contained ice or water onto the floor during the emptying of the spill collection tray.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
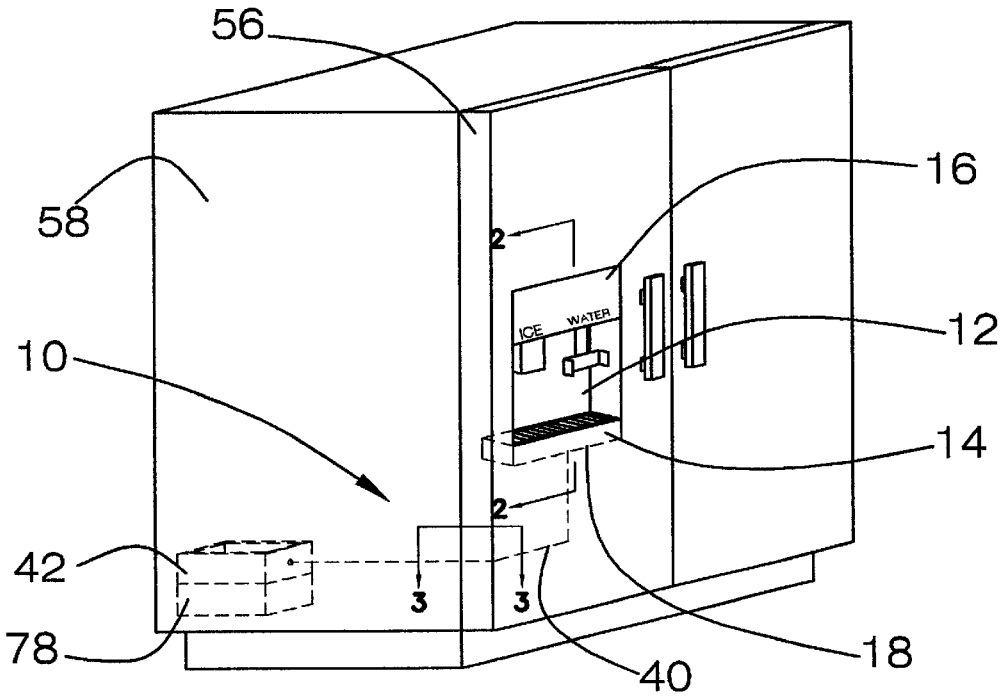
FIG. 1 is a top, left and front perspective view of the preferred embodiment of the refrigerator door dispenser spill shelf drain constructed in accordance with the principles of the present invention.

Referring now to the drawings, and particularly to FIGS. 1–5, a preferred embodiment of the refrigerator door dispenser spill shelf drain of the present invention is shown and generally designated by the reference numeral 10.

In FIG. 1, a new and improved refrigerator door dispenser spill shelf drain 10 of the present invention for draining the accumulated water from the spill collection tray 14 of a refrigerator door 56 mounted water and ice dispenser 16 is illustrated and will be described. More particularly, the refrigerator door dispenser spill shelf drain 10 is within a water and ice dispenser enclosure 12 beneath the water and ice dispenser 16 and consists of a spill collection tray 14, a molded grid 36, drain tubing 40 and a collection pan 42. The spill collection tray 14 has a spill collection tray bottom side 18 which abuts the water and ice dispenser enclosure bottom side 20, a spill collection tray back side 24 which abuts the water and ice dispenser enclosure back side 26, a spill collection tray right side 28 which abuts the water and ice dispenser enclosure right side 30, a spill collection tray left side 32 which abuts the water and ice dispenser enclosure left side 34, and a spill collection tray front side 22. The spill collection tray 14 has a molded fitting 38, which is shown on the spill collection tray bottom side 18. The drain tubing 40, collection pan 42, and refrigerator compressor 78 are shown in dashed lines, as they are not visible through the refrigerator door 56 and the refrigerator wall 58. The drain tubing 40 is shown as being routed the refrigerator door 56 and the refrigerator wall 58, but other routes are contemplated, and are included within the scope of this invention.

Figure 2:
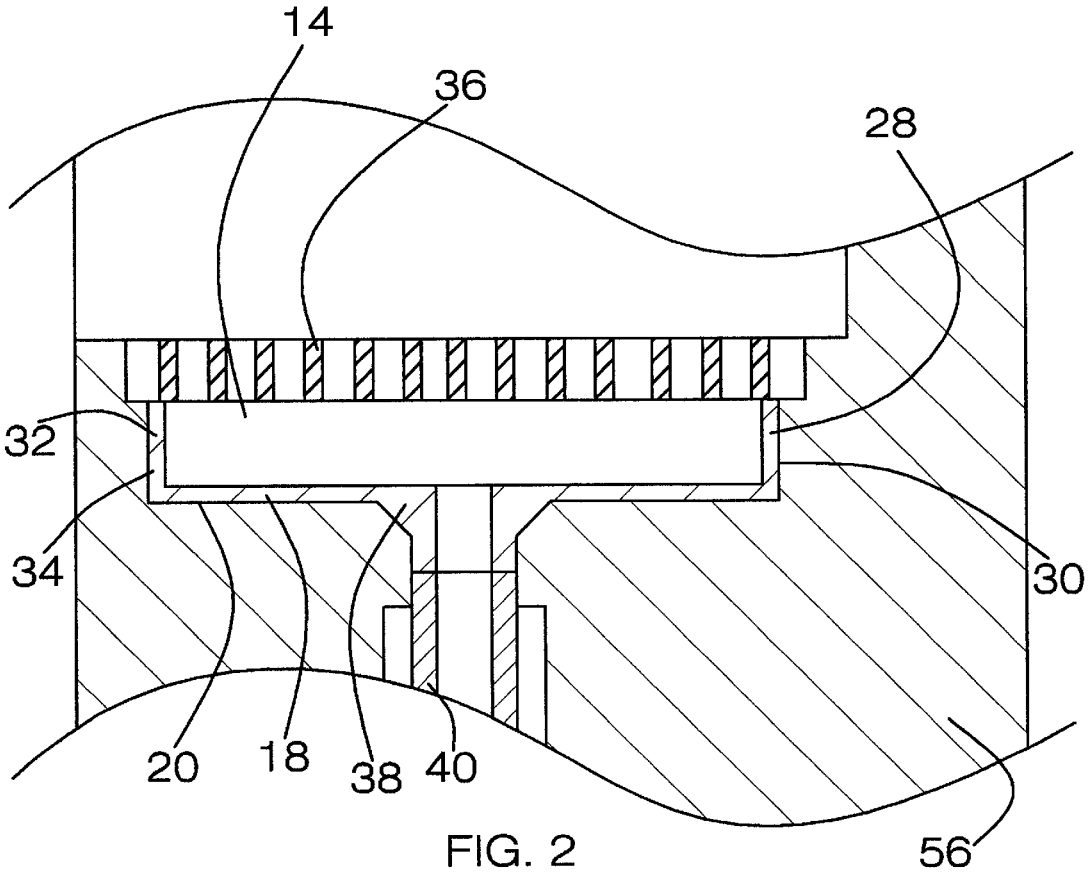
FIG. 2 is a cross sectional view of the refrigerator door dispenser spill shelf drain spill collector tray connector of the present invention, taken substantially along the line 2—2 of FIG. 1.

In FIG. 2, the refrigerator door dispenser spill shelf drain 10 is shown in cross section, taken along the lines 2—2 of FIG. 1. The spill collection tray 14, molded grid 36, molded fitting 38, and drain tubing 40 of the refrigerator door dispenser spill shelf drain 10 are shown in place within the refrigerator door 56. The spill collection tray bottom side 18 is shown abutted to the water and ice dispenser enclosure bottom side 20. The spill collection tray right side 28 is shown abutted to the water and ice dispenser enclosure right side 30. The spill collection tray left side 32 is shown abutted to the water and ice dispenser enclosure left side 34. The molded grid 36 is shown in place atop the spill collection tray 14. The molded fitting 38 is shown with the drain tubing 40 attached to the spill collection tray bottom side 18 and routed through the water and ice dispenser enclosure bottom side 20, but other routes are contemplated, and are included within the scope of this invention.

Figure 3:
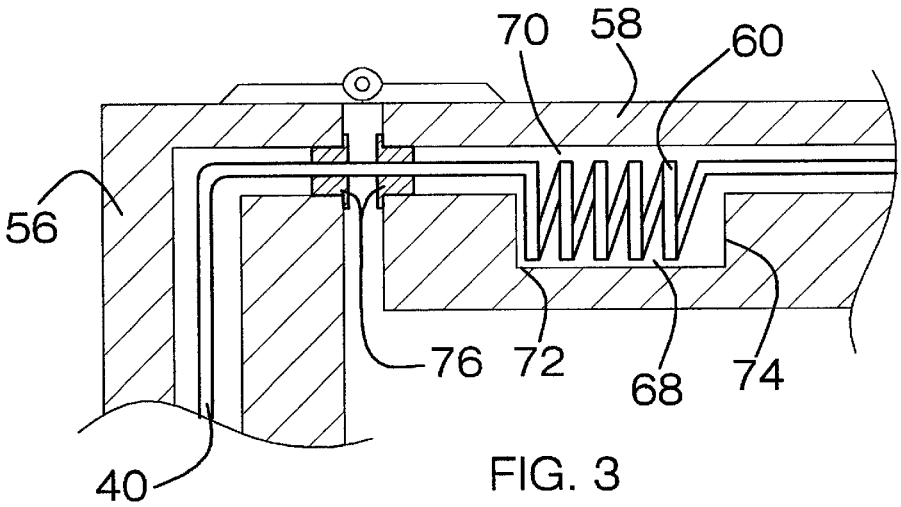
FIG. 3 is a cross sectional view of the refrigerator door dispenser spill shelf drain tube routing of the present invention, taken substantially along the line 3—3 of FIG. 1.

In FIG. 3 the refrigerator door dispenser spill shelf drain 10 is shown in cross section, taken along the lines 3—3 of FIG. 1. The drain tubing 40 is shown as being routed the refrigerator door 56 and the refrigerator wall 58, but other routes are contemplated, and are included within the scope of this invention. The drain tubing 40 is shown routed through the tubing guides 76. The tubing coiled segment 60 is shown within the tubing coiled segment enclosure 62. The tubing coiled segment enclosure left side 68, the tubing coiled segment enclosure right side 70, the tubing coiled segment enclosure front side 72, and the tubing coiled segment enclosure back side 74 are shown.

Figure 4:
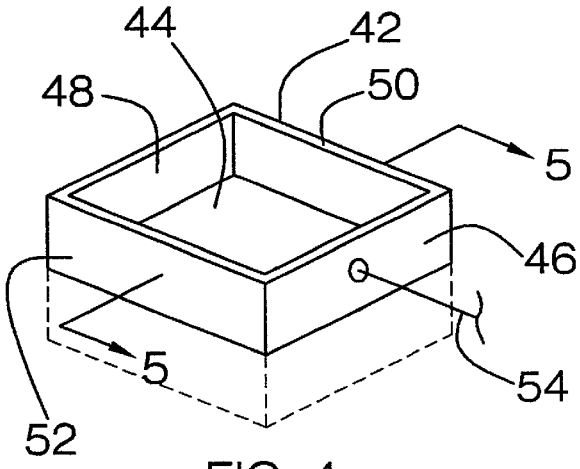
FIG. 4 is a top, left and front perspective view of the refrigerator door dispenser spill shelf drain collector and evaporator pan of the present invention.

In FIG. 4 the collection pan 42 is shown. The drain tubing 40 is shown as a straight line, and is terminated at a point before routing through the refrigerator wall 58. The bottom side 44 of the collection pan 42 retains the water that drains from the spill collection tray 14 and flows through the tubing 40. The drain tubing 40 is shown attached to the collection pan front side 46, attachment to the collection pan rear side 48, the collection pan right side 50, and the collection pan left side 52 are contemplated, and are included within the scope of this invention. The refrigerator compressor 78 is shown in dashed lines.

Figure 5:
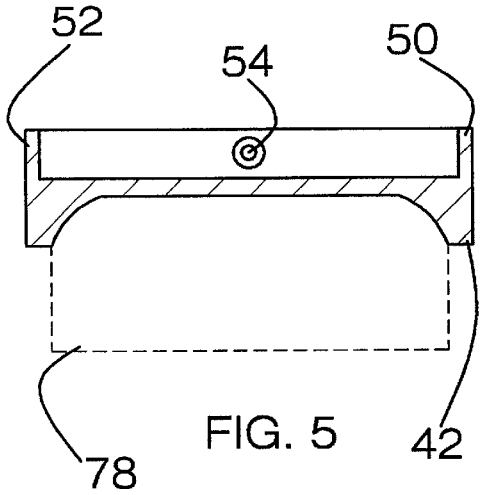
FIG. 5 is a cross sectional view of the refrigerator door dispenser spill shelf drain collector and evaporator pan of the present invention, taken substantially along the line 5—5 of FIG. 4.

In FIG. 5, the collection pan 42 is shown atop the refrigerator compressor 78. The refrigerator compressor 78 is shown using dashed lines. The molded fitting 54 of the collection pan 44 is shown as located on the front side 46 of the collection pan 42. The collection pan 42 is shown as sized to fit atop and to encompass the refrigerator compressor 78. The collection pan 42 can also mechanically attach to the refrigerator compressor 78, and this is claimed as being within the current invention.

In use, it can now be understood that the refrigerator door dispenser spill shelf drain is an improvement in the refrigerator dispensing apparatus, in that it obviates the need for intervention to remove the accumulated water from the spill collection tray. While a preferred embodiment of the refrigerator door dispenser spill shelf drain has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy water-resistant material such as metal, polycarbonate, or glass may be used instead of the plastic evaporator collector pan described. Also, the drain tubing may also be made of heavy-duty rubber, vinyl, or similar material. And although draining a refrigerator spill shelf has been described, it should be appreciated that the refrigerator door dispenser spill shelf drain herein described is also suitable for removing collected water from a large variety of surfaces and sources. Furthermore, a wide variety of routing of the drain tubing may be used instead of the refrigerator door and refrigerator wall routing described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A refrigerator door dispenser spill shelf drain comprising:

a water and ice dispenser enclosure containing a spill collection tray positioned below said water and ice dispenser and spaced apart therefrom to collect water and ice from said water and ice dispenser;

said spill collection tray fitting within said water and ice dispenser enclosure and having a bottom side adjacent to the bottom side of said water and ice dispenser enclosure, a front side, a back side adjacent to the back side of said water and ice dispenser enclosure, a right side adjacent to the right side of said water and ice dispenser enclosure, a left side adjacent to the left side of said water and ice dispenser enclosure;

a molded grid attached to the top of said walls;

said spill collection tray containing a molded fitting that encompasses an exit port extending completely through said spill collection tray;

tubing attached to said molded fitting leading to a collection pan;

said collection pan having a bottom side, a front side, a rear side, a right side and a left side, and containing a molded fitting that encompasses an inlet port extending completely through said collection pan.

2. The refrigerator door dispenser spill shelf drain according to claim 1, wherein said molded fitting on said spill collection tray is located on said bottom side.

3. The refrigerator door dispenser spill shelf drain according to claim 1, wherein said molded fitting on said spill collection tray is located on said left side.

4. The refrigerator door dispenser spill shelf drain according to claim 1, wherein said molded fitting on said spill collection tray is located on said right side.

5. The refrigerator door dispenser spill shelf drain according to claim 1, wherein said molded fitting on said spill collection tray is located on said back side.

6. The refrigerator door dispenser spill shelf drain according to claim 1, wherein said molded fitting on said collector pan is located on said bottom side.

7. The refrigerator door dispenser spill shelf drain according to claim 1, wherein said molded fitting on said collector pan is located on said left side.

8. The refrigerator door dispenser spill shelf drain according to claim 1, wherein said molded fitting on said collector pan is located on said right side.

9. The refrigerator door dispenser spill shelf drain according to claim 1, wherein said drain tubing is routed through the door and through the side wall of the refrigerator.

10. The refrigerator door dispenser spill shelf drain according to claim 9, wherein said drain tubing has a coiled segment that lies within an enclosure within said side wall of said refrigerator, said enclosure having a top, bottom, opposite left and right sides and opposite front and back sides.

11. The refrigerator door dispenser spill shelf drain according to claim 9, wherein said drain tubing is routed through guides in said door and said side wall.

12. The refrigerator door dispenser spill shelf drain according to claim 1, wherein said collection pan is sized to encompass the top of a refrigerator compressor.

13. The refrigerator door dispenser spill shelf drain according to claim 12, wherein said collection pan is mechanically attached to the refrigerator compressor.

14. The refrigerator door dispenser spill shelf drain according to claim 1, wherein said drain tubing is polyethylene.

15. The refrigerator door dispenser spill shelf drain according to claim 1, wherein said drain tubing is polypropylene.

16. The refrigerator door dispenser spill shelf drain according to claim 1, wherein said drain tubing is polyvinyl chloride.

17. A refrigerator door dispenser spill shelf drain comprising:

a water and ice dispenser enclosure containing a spill collection tray positioned below said water and ice dispenser and spaced apart therefrom to collect water and ice from said water and ice dispenser;

said spill collection tray fitting within said water and ice dispenser enclosure and having a bottom side adjacent to the bottom side of said water and ice dispenser enclosure, a front side, a back side adjacent to the back side of said water and ice dispenser enclosure, a right side adjacent to the right side of said water and ice dispenser enclosure, a left side adjacent to the left side of said water and ice dispenser enclosure;

a molded grid attached to the top of said walls;

said spill collection tray containing a molded fitting that encompasses an exit port extending completely through said bottom side of said spill collection tray;

tubing attached to said molded fitting leading to a collection pan, said tubing being routed through guides in the door and side wall of said refrigerator, said tubing has a coiled segment that lies within an enclosure within said side wall of said refrigerator, said enclosure having a top, bottom, opposite left and right sides and opposite front and back sides;

said collection pan having a bottom side, a front side, a rear side, a right side and a left side, and containing a molded fitting that encompasses an inlet port extending completely through said front side of said collection pan, said collection pan being sized to encompass the top of a refrigerator compressor.

18. The refrigerator door dispenser spill shelf drain according to claim 17, wherein said collection pan is mechanically attached to said refrigerator compressor.

19. The refrigerator door dispenser spill shelf drain according to claim 17, wherein said drain tubing is selected from the set of polyethylene, polyvinyl chloride, copper, or polypropylene.

20. A refrigerator door dispenser spill shelf drain comprising:

a water and ice dispenser enclosure containing a plastic molded spill collection tray positioned below said water and ice dispenser and spaced apart therefrom to collect water and ice from said water and ice dispenser;

said spill collection tray fitting within said water and ice dispenser enclosure and having a bottom side adjacent to the bottom side of said water and ice dispenser enclosure, a front side, a back side adjacent to the back side of said water and ice dispenser enclosure, a right side adjacent to the right side of said water and ice dispenser enclosure, a left side adjacent to the left side of said water and ice dispenser enclosure;

a molded grid attached to the top of said walls;

said spill collection tray containing a molded fitting that encompasses an exit port extending completely through said bottom side of said spill collection tray;

tubing attached to said molded fitting leading to a plastic molded collection pan, said tubing being routed through guides in the door and side wall of said refrigerator, said tubing has a coiled segment that lies within an enclosure within said side wall of said refrigerator, said enclosure having a top, bottom, opposite left and right sides and opposite front and back sides;

said drain tubing is selected from the set of polyethylene, polyvinyl chloride, copper, or polypropylene;

said collection pan having a bottom side, a front side, a rear side, a right side and a left side, and containing a molded fitting that encompasses an inlet port extending completely through said front side of said collection pan, said collection pan being sized to encompass the top of a refrigerator compressor.

* * * * *